US005741159A

United States Patent [19]

Wright

[11] Patent Number: 5,741,159

[45] Date of Patent: Apr. 21, 1998

[54] CONNECTOR AND CONNECTOR KIT

[75] Inventor: John O. Wright, York, Pa.

[73] Assignee: Osram Sylvania Inc., Danvers, Mass.

[21] Appl. No.: 803,054

[22] Filed: Feb. 19, 1997

[51] Int. Cl.[6] ..... H01R 17/04

[52] U.S. Cl. ..... 439/668; 439/752.5; 439/63

[58] Field of Search ..... 439/668, 675, 439/63, 581, 79, 80, 851, 752.5

[56] References Cited

U.S. PATENT DOCUMENTS

| | | | |
|---|---|---|---|
| 5,147,221 | 9/1992 | Cull et al. | 439/675 |
| 5,547,400* | 8/1996 | Wright | 439/668 |
| 5,662,481 | 9/1997 | Wright | 439/581 |

*Primary Examiner*—Neil Abrams
*Assistant Examiner*—Tho Dac Ta
*Attorney, Agent, or Firm*—William H. McNeill

[57] ABSTRACT

A connector and connector kit is provided which includes an insulative housing, a conductive shell and a contact. When assembled, the contact and conductive shell are contained in the insulative housing. In particular, the conductive shell includes one segment which is positioned in a cavity which extends into one surface of the housing, and another segment which extends out of such cavity and into a groove provided at an end of the housing. The contact is positioned in a bore which extends into the housing from an opposite end of the housing to the cavity. The contact and the bore include abutments which engage one another when the connector is assembled to assure proper positioning of the contact relative to the housing.

18 Claims, 3 Drawing Sheets

CONNECTOR AND CONNECTOR KIT

TECHNICAL FIELD

The present invention relates to a connector and a connector kit. The present invention is particularly useful in providing an antenna connector assembly including the connector of the present invention and an antenna cable.

BACKGROUND ART

A typical antenna connector for an antenna cable such as those used in the automobile industry for radios includes a male connector generally in the form of a plug and a female connector generally in the form of a ferrule which forms a socket. In use, the male connector is plugged into the female connector to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior art devices inadvertent axial and/or rotational movement of the male connector body relative to the female connector body makes providing a satisfactory electrical connection difficult. In addition, the lack of satisfactory tactile feedback makes it difficult to know when a suitable connection has been made. Properly positioning the male or female contact and a conductive shell within an insulated housing has also been a concern in the assembly of a typical antenna connector.

DISCLOSURE OF THE INVENTION

It is therefore an object of the present invention to provide an improved connector wherein a male connector body does not inadvertently move in a rotational and/or an axial direction relative to a female connector body.

It is another object of the present invention to provide a connector which provides tactile feedback when connected to another connector.

A further object of the present invention is to provide a connector having a conductive shell contained within an insulative housing wherein the shell does not move in a rotational and/or an axial direction relative to the housing.

Another object of the present invention is to provide a connector which allows for effecting an improved connector assembly.

Another object of the present invention is to provide a connector having a housing, contact and conductive shell which are configured to assure proper positioning of the contact relative to the housing.

Yet a further object of the present invention is to provide a relatively simple connector, the components of which may be in kit form.

This invention achieves these and other objects, in one aspect of the invention, by providing an assembled connector the components of which comprise an insulative housing, a conductive shell and a contact. A connector kit is also provided which includes each of these connector components. The insulative housing of the present invention includes a first length and a second length which extends from the first length. The first length and the second length extend in the direction of a longitudinal axis of the housing. The housing includes a first surface, an opposite second surface and a cavity which extends into the first length from the first surface towards the opposite second surface. The cavity further extends in the direction of the longitudinal axis from a first end of the housing to the second length of the housing. A bore extends through the second length of the housing in the direction of the longitudinal axis from an opposite second end of the housing to the cavity, the bore opening into the cavity. The first surface of the housing comprises a slot which extends in the direction of the longitudinal axis between the first end of the housing and the second length of the housing. The slot extends through the housing from the first surface to the cavity. The bore has a bore surface which comprises a first abutment spaced from the opposite second end of the housing, and the opposite second end of the housing comprises at least one groove.

A conductive shell extends in the direction of the longitudinal axis and comprises a first segment and a second segment which extends from the first segment. The first segment is positioned in the cavity and the second segment extends through the slot and out of the cavity. The second segment is adjacent a surface of the second length of the housing and has at least one leg which is folded into at least one groove at the opposite second end of the housing.

A contact extends in the direction of the longitudinal axis and comprises a first portion and a second portion extending from the first portion. The first portion is positioned in the housing bore and the second portion extends from the bore at the opposite second end of the housing. The first portion of the contact comprises a mating second abutment which contacts the abutment of the housing bore.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
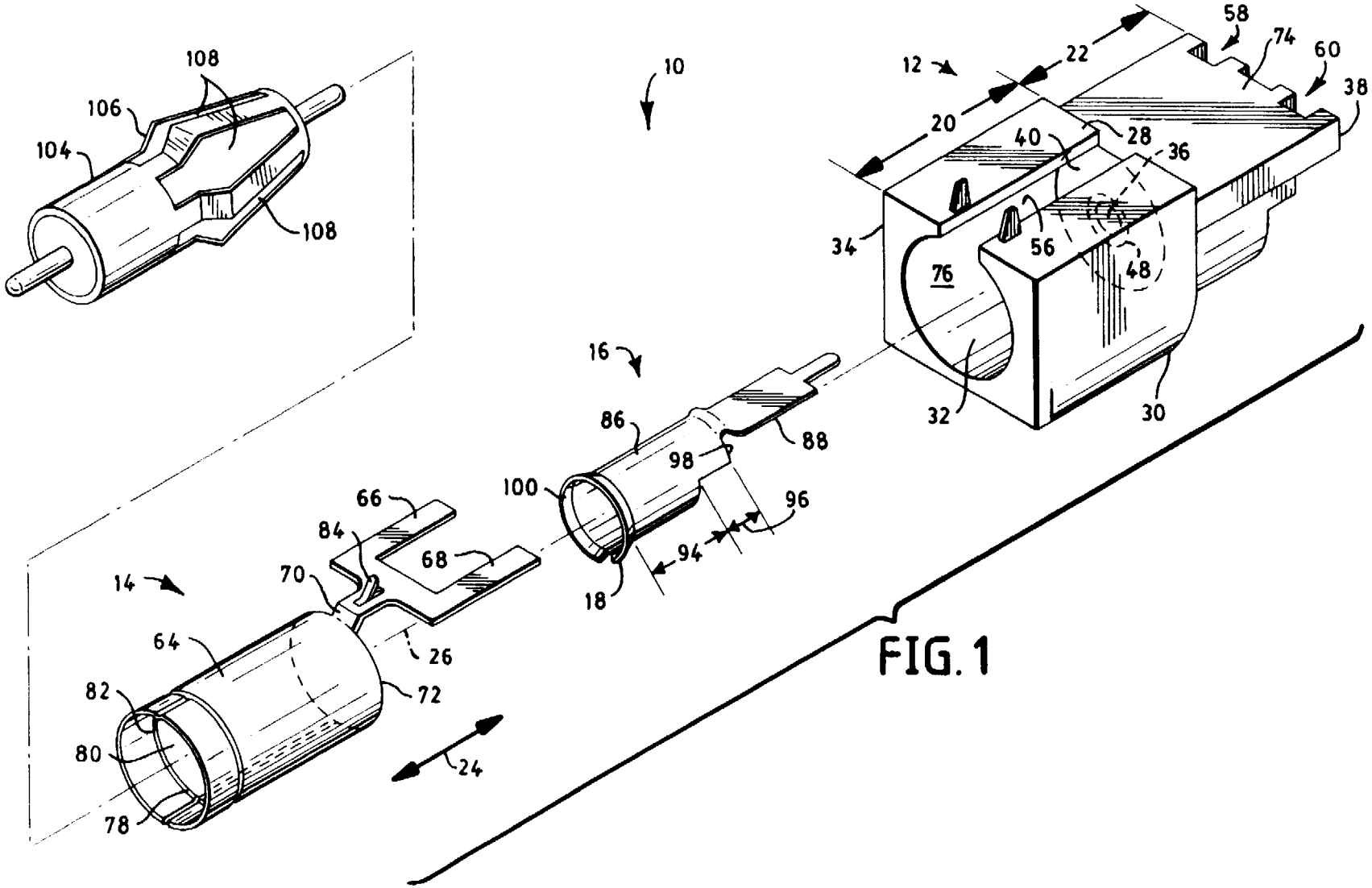
FIG. 1 is an exploded perspective view of one embodiment of the present invention depicting the components of a connector kit of the present invention and their assembled relationship as a connector of the present invention for use with a mating connector.

The embodiment of this invention which is illustrated in FIG. 1 is particularly suited for achieving the objects of this invention. FIG. 1 depicts a connector 10 comprising an insulative housing 12, a conductive connector shell 14 and a contact 16. In the embodiment of FIG. 1, contact 16 is in the form of a female contact comprising a ferrule 18 into which a male contact prong may be inserted in the usual manner. It will be readily apparent to those having ordinary skill in the art, however, that contact 16 may be a male contact having a conventional prong for mating with a female contact in the usual manner.

The insulative housing 12 comprises a first length 20 and a second length 22 extending from the first length. First length 20 and second length 22 extend in the direction 24 of a longitudinal axis 26 of the housing 12. Housing 12 further comprises an upper surface 28 and an opposite lower surface 30. A cavity 32 extends into the first length 20 of the insulative housing 12 from surface 28 towards the opposite surface 30. The cavity 32 extends in the direction 24 of the longitudinal axis 26 from a housing end 34 to the second length 22. With reference to FIGS. 1 to 5, a bore 36 extends through the second length 22 of the insulative housing 12 in the direction 24 from an opposite housing end 38 to the cavity 32. The bore 36 opens into cavity 32 at surface 40.

Figure 3:
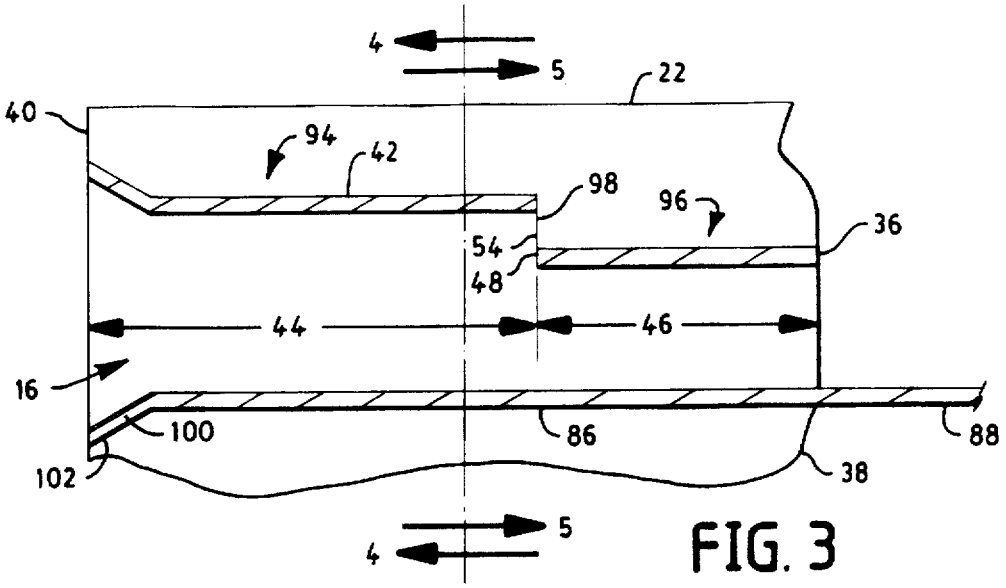
FIG. 3 is a section view of FIG. 2 taken along lines 3—3, with the contact 16 of FIG. 1 inserted in place.
Figure 4:
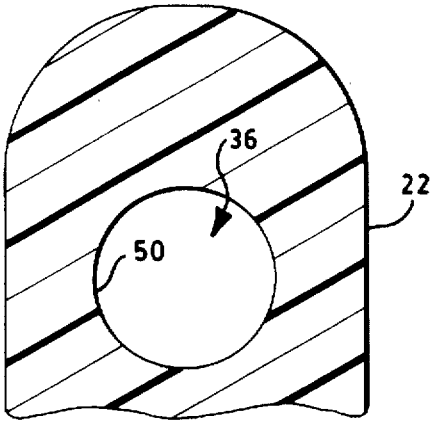
FIG. 4 is a section view of FIG. 3 taken along lines 4—4 with the contact 16 removed.
Figure 5:
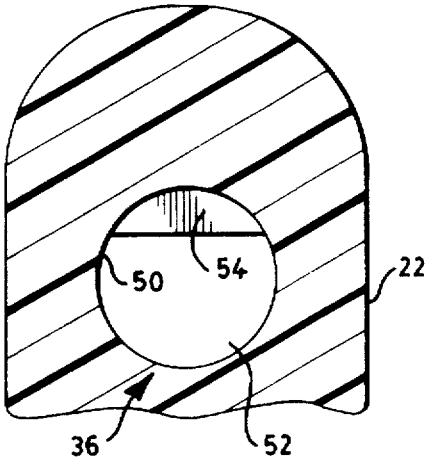
FIG. 5 is a section view of FIG. 3 taken along lines 5—5 with the contact 16 removed.

With particular reference to FIG. 3, the bore 36 includes a bore surface 42 which comprises an abutment spaced from the end 38 of the housing 12. For example, in the embodiment illustrated in the drawings, the bore 36 includes a first region 44 which extends from the cavity 32 at surface 40 towards end 38, and a second region 46 which extends from end 38 towards cavity 32. The second region 46 opens into the first region 44 at 48. The first region 44 is in the shape of a circle 50 when the bore 36 is viewed in cross section taken in the direction 24, as depicted in FIG. 4. The second region 46 is in the shape of a first segment 52 of circle 50 when the bore 36 is viewed in cross section taken in the direction 24, as depicted in FIG. 5. An abutment is provided by the remaining second segment 54 of circle 50 as depicted in FIG. 5.

The upper surface 28 of the housing 12 comprises a slot 56 which extends in the direction 24 from end 34 to the second length 22. Slot 56 extends through the housing 12 from surface 28 to the cavity 32.

Figure 2:
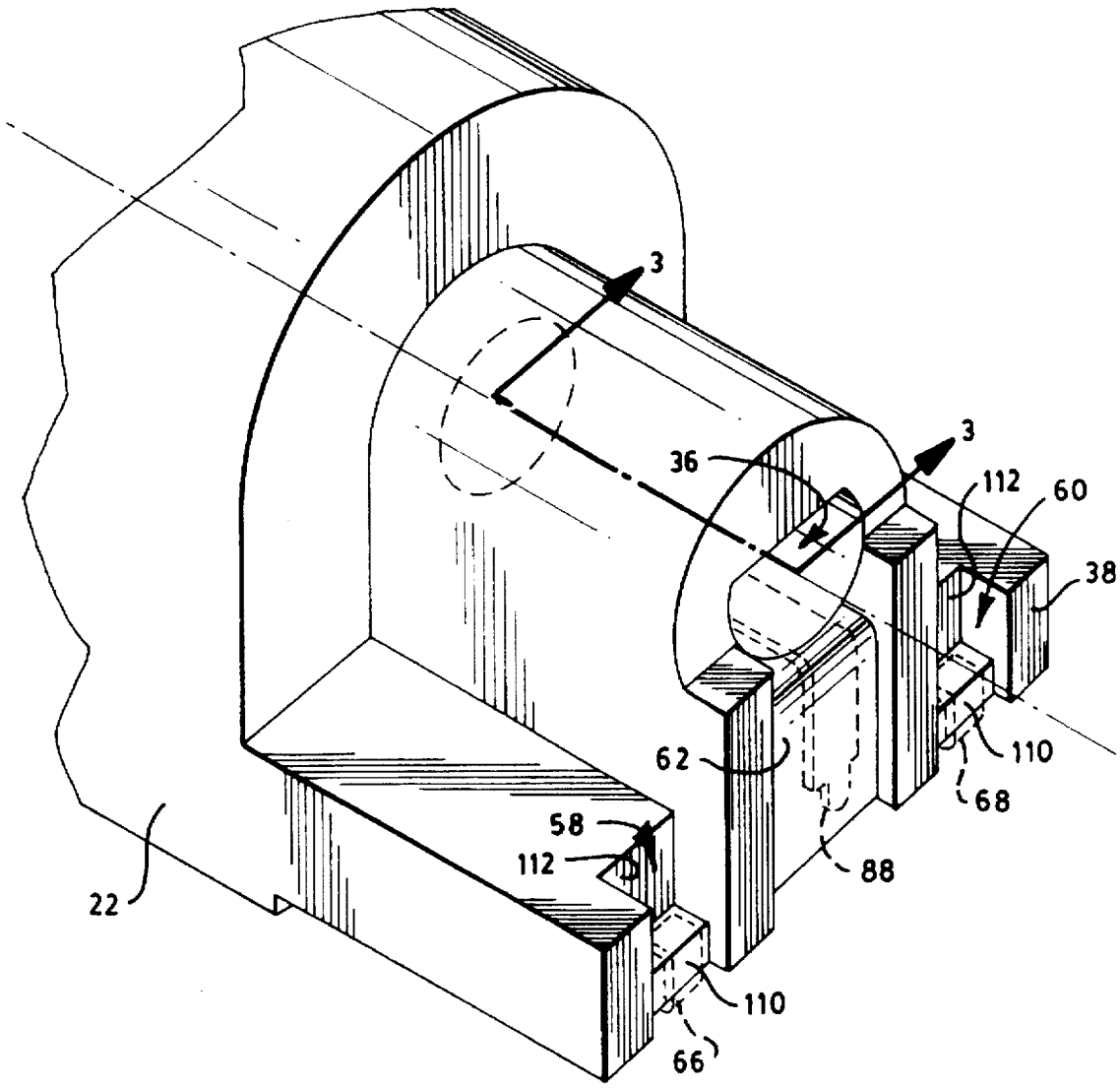
FIG. 2 is an inverted partial perspective view of the housing 12 of FIG. 1.

The end 38 comprises at least one groove. With particular reference to FIG. 2, end 38 comprises a first groove 58 and a second groove 60. End 38 also includes a channel 62 which is preferably positioned between groove 58 and groove 60.

The conductive connector shell comprises a first segment and a second segment extending from the first segment, the first segment being positioned in the cavity of the insulative housing and the second segment comprising at least one leg and extending out of such cavity. For example, in the embodiment of FIG. 1, the conductive shell 14 comprises a first segment in the form of a resilient split ring 64 and a second segment which comprises of a first leg 66 and second leg 68 joined to a tab 70 which extends from a peripheral edge 72 of the split ring. The conductive-shell may be fabricated from resilient metal to facilitate assembly as described herein. The split ring 64 is positioned in the cavity 32. The tab 70 extends through slot 56 and out of cavity 32 such that the legs 66 and 68 are adjacent a surface 74 of the second length 22 of the housing. After the connector shell 14 has been inserted into housing 12, legs 66 and 68 are folded into a respective groove 58 and 60 as depicted in phantom lines in FIG. 2. In the embodiment of FIG. 1, the cavity 32 comprises a cylindrical portion 76 configured and dimensioned to mate with the split ring 64.

In the preferred embodiment the first segment of the conductive shell 14 comprises at least one protuberance which extends from the first segment towards longitudinal axis 26. For example in the embodiment of FIG. 1, the split ring 64 comprises a circumferential protuberance 78 which extends from an inner surface 80 of the split ring towards longitudinal axis 26. At least one additional similar protuberance 82 may be provided extending in the direction 24 of the longitudinal axis 26.

In the preferred embodiment, the second segment of the conductive shell comprises at least one tab extending away from a surface of the insulative housing. For example, in the embodiment of FIG. 1, the tab 70 comprises a tab 84 which extends away from surface 74 of the second length 22.

Figure 6:
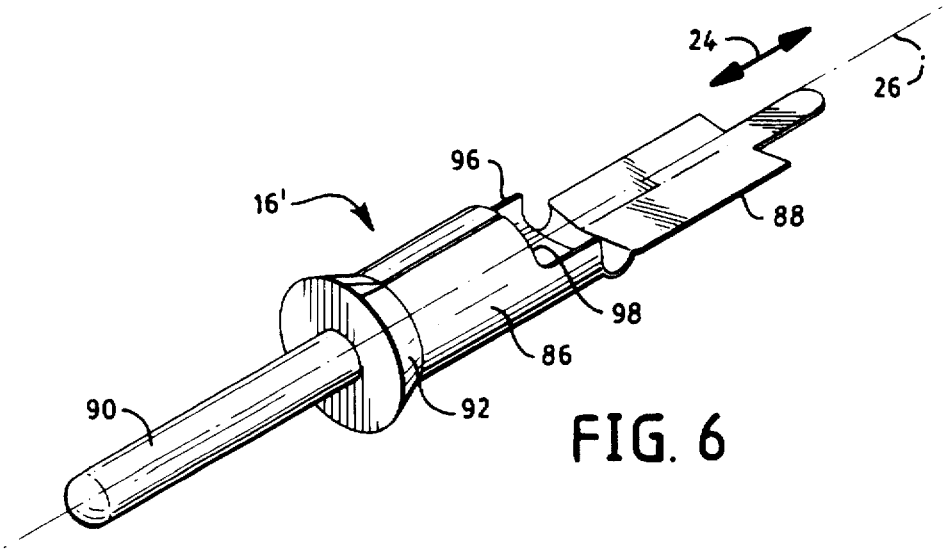
FIG. 6 is a perspective view of an alternate embodiment of the present invention.

Contact 16 extends in direction 24 and comprises a first portion 86 and a second portion 88 extending therefrom. The first portion 86 is positioned in bore 36 and the second portion 88 extends from such bore at end 38 of the insulative housing 12. As noted, contact 16 is depicted as a female contact in the form of a ferrule 18. In those instances where contact 16 is a male contact such as contact 16' of FIG. 6, a conventional male prong 90 will extend in the direction 24 away from the first portion 86. The male contact of FIG. 6 will be assembled with the housing 12 of FIG. 1 in the same manner as the female contact 16 of FIG. 1. When assembled the male prong 90 will extend into cavity 32 and towards end 34 of the insulative housing 12. For example, considering the contact 16' of the embodiment of FIG. 6, wherein like elements are designated by like reference numerals, the contact 16' will be inserted into bore 36 until collar 92 engages surface 40 such that prong 90 extends into cavity 32 and the first portion 86 and second portion 88 extend into and through bore 36, respectively as depicted in FIG. 3. Whether the contact is a male contact 16' or female contact 16, when assembled a mating abutment of the contact will contact the abutment provided in the bore. For example, in the embodiment illustrated in the drawings, the first portion 86 comprises a cylindrical section 94 and a partial cylindrical section 96 which extends from an end edge 98 of the cylindrical section. In the preferred embodiment the cylindrical section 94 is a resilient split ring and the second portion 88 extends from the partial cylindrical section 96. With particular reference to FIGS. 3 to 5, the end edge 98 provides the mating abutment of the contact 16 which contacts the abutment 54 when the contact is fully inserted into the bore.

In assembling the connector 10 of FIG. 1, a kit may be provided which comprises the insulative housing 12, the conductive shell 14 and the contact 16. Assembly of the connector includes inserting the contact 16 into bore 36 from end 34 of the housing 12, and pushing the contact through the bore until the first abutment 54 contacts the second abutment 98. In such position, the first portion 86 of the contact is positioned in the bore and the flared end 100 of the contact mates with the flared end 102 of the bore as illustrated best in FIG. 3. The second portion 88 of the contact 16 will extend from the bore 36 at end 38 of the housing 12 and may be bent or folded until the second portion is positioned in channel 62 as depicted in phantom lines in FIG. 2. The conductive shell 14 may then be inserted into the cavity 32 of the housing 12 from end 34. While moving the conductive shell 14 into cavity 32 of housing 12, the legs 66 and 68 and tab 70 will extend between slot 56 such that the second segment of the conductive shell 14 is adjacent the surface 74 of the second length 22 of the housing 12. When in this position each leg 66 and 68 may be folded into respective groove 58 and 60 as shown in phantom in FIG. 2.

In those instances where the conductive shell 14 comprises a resilient split ring 64, and the cylindrical section 94 of the contact 16 comprises a resilient split ring, such split rings will be deformed in the conventional manner to the extent that they may be inserted into cavity 32 and bore 36, respectively, the dimension of the split rings being such that when in place within such cavity and bore the resilience of the split rings will cause the split rings to bear against the surfaces which form the cavity and bore, respectively. Such engagement between the split ring 64 and the cylindrical portion 76 and the split ring 86 and surface 42 of bore 36 will deter axial movement of the conductive shell 14 and contact 16 relative to the housing 12.

When a male contact 104, or a female contact (not shown), is connected to the female contact 16, or the male contact 16', respectively, in a conventional manner, tactile feedback will be provided by positioning the protuberance 78 such that it will mate with a depressed area 106 of the contact when the male and female contacts are properly mechanically and electrically coupled together. The interrelationship between protuberance 78 and depressed area 106 will also serve to minimize the likelihood that the contacts will become inadvertently disconnected by being inadvertently moved in direction 24. The presence of protuberance 82 in an opening 108 of contact 106 will also prevent rotational and axial movement of the contact 104 relative to the conductive shell 14 and contact 16. Protuberances 78 and 82 also provide a satisfactory ground vis-a-vis the contact 16 (or 16') and tactile feedback when the contacts are mated together.

Movement of the conductive shell 14 relative to the housing 12 in an axial and rotational direction relative to longitudinal axis 26 may be further prevented by providing the grooves 58 and 60 with step-like protuberances 110 which extend from a base 112 of grooves 58 and 60. In such embodiment, the legs 66 and 68 may be folded around respective step-like protuberances 110 as illustrated in FIG. 2.

Fabrication of the various components described herein may be accomplished using conventional procedures. For example, the insulative housing may be molded from a plastic material. The conductive members including male and female contacts and connector shell may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector comprising:

an insulative housing having a first length and a second length extending from said first length, said first length and said second length extending in the direction of a longitudinal axis of said housing, a first surface, an opposite second surface, a cavity extending into said first length from said first surface towards said opposite second surface, said cavity further extending in the direction of said longitudinal axis from a first end of said housing to said second length and a bore extending through said second length in the direction of said longitudinal axis from an opposite second end of said housing to said cavity, said bore opening into said cavity, said first surface comprising a slot which extends in the direction of said longitudinal axis between said first end and said second length, said slot extending through said housing from said first surface to said cavity, said bore having a bore surface which comprises a first abutment spaced from said opposite second end, said opposite second end comprising at least one groove;

a conductive shell extending in the direction of said longitudinal axis and comprising a first segment and a second segment extending from said first segment, said first segment being positioned in said cavity and said second segment extending through said slot and out of said cavity, said second segment being adjacent a surface of said second length and having at least one leg which is folded into said at least one groove; and a contact extending in the direction of said longitudinal axis and comprising a first portion and a second portion extending from said first portion, said first portion being positioned in said bore and said second portion extending from said bore at said opposite second end, said first portion comprising a mating second abutment which contacts said first abutment.

2. The connector of claim 1 wherein said first portion comprises a cylindrical section and a partial cylindrical section extending from an end edge of said cylindrical section, said second portion extending from said partial cylindrical section, and further wherein said end edge is said mating second abutment.

3. The connector of claim 1 wherein a first region of said bore is in the shape of a circle when said bore is viewed in cross section taken in said direction, and further wherein a second region of said bore is in the shape of a segment of said circle when said bore is viewed in cross section taken in said direction, said first abutment being in the shape of a remaining segment of said circle when said bore is viewed in cross section taken in said direction.

4. The connector of claim 1 wherein said at least one groove comprises a protuberance extending from a base of said at least one groove, and further wherein said at least one leg is folded around said protuberance.

5. The connector of claim 1 wherein said second end comprises a channel and further wherein said second portion is folded into said channel.

6. The connector of claim 5 wherein said at least one groove comprises a first groove and a second groove, and further wherein said at least one leg comprises a first leg and a second leg, said first leg being folded into said first groove and said second leg being folded into said second groove.

7. The connector of claim 6 wherein said channel is positioned between said first groove and said second groove.

8. The connector of claim 1 wherein said at least one groove comprises a first groove and a second groove, and further wherein said at least one leg comprises a first leg and a second leg, said first leg being folded into said first groove and said second leg being folded into said second groove.

9. The connector of claim 8 wherein said first groove comprises a first protuberance extending from a base of said first groove, and said second groove comprises a second protuberance extending from a base of said second groove, and further wherein said first leg is folded around said first protuberance and said second leg is folded around said second protuberance.

10. A connector kit comprising:

an insulative housing having a first length and a second length extending from said first length, said first length and said second length extending in the direction of a longitudinal axis of said housing, a first surface, an opposite second surface, a cavity extending into said first length from said first surface towards said opposite second surface, said cavity further extending in the direction of said longitudinal axis from a first end of said housing to said second length and a bore extending through said second length in the direction of said longitudinal axis from an opposite second end of said housing to said cavity, said bore opening into said cavity, said first surface comprising a slot which extends in the direction of said longitudinal axis between said first end and said second length, said slot extending through said housing from said first surface to said cavity, said bore having a bore surface which comprises a first abutment spaced from said opposite second end, said opposite second end comprising at least one groove;

a conductive shell comprising a first segment and a second segment extending from said first segment, said first segment being adapted for insertion into said cavity and said second segment being adapted for extension through said slot and out of said cavity, said second segment being adapted to be positioned adjacent a surface of said second length and having at least one leg which is adapted to be folded into said at least one groove; and a contact comprising a first portion and a second portion adapted to extend from said first portion, said first portion being adapted for insertion into said bore, and said second portion being adapted to extend from said bore at said opposite second end, said first portion comprising a mating second abutment which is adapted to contact said first abutment.

11. The connector kit of claim 10 wherein said first portion comprises a cylindrical section and a partial cylindrical section extending from an end edge of said cylindrical section, said second portion extending from said partial cylindrical section, and further wherein said end edge is said mating second abutment.

12. The connector kit of claim 10 wherein a first region of said bore is in the shape of a circle when said bore is viewed in cross section taken in said direction, and further wherein a second region of said bore is in the shape of a segment of said circle when said bore is viewed in cross section taken in said direction, said first abutment being in the shape of a remaining segment of said circle when said bore is viewed in cross section taken in said direction.

13. The connector kit of claim 10 wherein said at least one groove comprises a protuberance extending from a base of said at least one groove, and further wherein said at least one leg is adapted to be folded around said protuberance.

14. The connector kit of claim 11 wherein said second end comprises a channel and further wherein said second portion is adapted to be folded into said channel.

15. The connector kit of claim 14 wherein said at least one groove comprises a first groove and a second groove, and further wherein said at least one leg comprises a first leg and a second leg, said first leg being adapted to be folded into said first groove and said second leg being adapted to be folded into said second groove.

16. The connector kit of claim 14 wherein said channel is positioned between said first groove and said second groove.

17. The connector kit of claim 10 wherein said at least one groove comprises a first groove and a second groove, and further wherein said at least one leg comprises a first leg and a second leg, said first leg being adapted to be folded into said first groove and said second leg being adapted to be folded into said second groove.

18. The connector kit of claim 17 wherein said first groove comprises a first protuberance extending from a base of said first groove, and said second groove comprises a second protuberance extending from a base of said second groove, and further wherein said first leg is adapted to be folded around said first protuberance and said second leg is adapted to be folded around said second protuberance.

* * * * *